US010039318B2

(12) United States Patent
Daryani

(10) Patent No.: US 10,039,318 B2
(45) Date of Patent: Aug. 7, 2018

(54) ELECTRONIC SMOKING DEVICE WITH MOUTHPIECE

(71) Applicant: FONTEM HOLDINGS 1 B.V., Amsterdam (NL)

(72) Inventor: Neha Daryani, Hamburg (DE)

(73) Assignee: FONTEM HOLDINGS 1 B.V., Amsterdam (NL)

( * ) Notice: Subject to any disclaimer, the term of this patent is extended or adjusted under 35 U.S.C. 154(b) by 0 days.

(21) Appl. No.: 15/311,155

(22) PCT Filed: May 7, 2015

(86) PCT No.: PCT/EP2015/060036
§ 371 (c)(1),
(2) Date: Nov. 14, 2016

(87) PCT Pub. No.: WO2015/173105
PCT Pub. Date: Nov. 19, 2015

(65) Prior Publication Data

US 2017/0086498 A1 Mar. 30, 2017

(30) Foreign Application Priority Data

May 15, 2014 (EP) ..... 14168436

(51) Int. Cl.
*A24F 13/00* (2006.01)
*A24F 7/02* (2006.01)
*A24F 47/00* (2006.01)

(52) U.S. Cl.
CPC ..... *A24F 7/02* (2013.01); *A24F 47/008* (2013.01)

(58) Field of Classification Search
CPC ..... A24F 7/02; A24F 47/008; A24D 1/02; A24D 1/04; A24D 1/002
(Continued)

(56) References Cited

U.S. PATENT DOCUMENTS 5,320,095 A * 6/1994 Nijkerk ..... A61M 15/0028 128/203.15
6,545,218 B1 * 4/2003 Blaess ..... H01R 13/4532 174/53

(Continued)

FOREIGN PATENT DOCUMENTS

| | | | |
|---|---|---|---|
| EP | 0198268 | A2 | 10/1986 |
| WO | 2012062600 | A1 | 5/2012 |
| WO | 2013020220 | A4 | 3/2013 |

OTHER PUBLICATIONS

European Patent Office, "Extended European Search Report", for EP14168436.5, dated Oct. 16, 2014, 4 pgs.

(Continued)

*Primary Examiner* — Phuong Dinh

(74) *Attorney, Agent, or Firm* — Perkins Coie LLP; Kenneth H. Ohriner

(57) ABSTRACT

An electronic cigarette allows for replacing a spent liquid capsule or container with a new capsule, without requiring the user to touch the spent capsule. A capsule is positioned on a capsule seat on or in the housing of the electronic cigarette. After the liquid in the capsule is consumed and the capsule is spent, the mouthpiece of the electronic cigarette is removed, The spent cartridge is captive in the mouthpiece so that it is removed with the mouthpiece. A fresh capsule is placed on the capsule seat. As the mouthpiece is reattached to the housing, the spent cartridge is ejected out of the mouthpiece. An absorber in the mouthpiece may be provided to absorb any condensed vapor liquid.

19 Claims, 4 Drawing Sheets

(58) Field of Classification Search
USPC ..... 131/173–290, 328–329, 337, 108
See application file for complete search history.

(56) References Cited

U.S. PATENT DOCUMENTS

2014/0311508 A1* 10/2014 Besso ..... A24D 3/048
131/337
2016/0007649 A1* 1/2016 Sampson ..... A24F 7/02
131/187

OTHER PUBLICATIONS

European Patent Office, "International Search Report and Written Opinion" for PCT/EP2015/060036, dated Aug. 3, 2015, 8 pgs.

* cited by examiner

ELECTRONIC SMOKING DEVICE WITH MOUTHPIECE

BACKGROUND OF THE INVENTION

The field of the invention is electronic cigarettes and similar electronic smoking devices.

Electronic smoking devices, such as electronic cigarettes, have become well-known products. Generally, an electronic cigarette has a mouthpiece on one end of a housing. An electric power source, such as a rechargeable battery, an electrically heatable atomizer and control electronics including an inhalation sensor are typically included within the housing. When the sensor detects a user inhaling on the mouth piece, the control electronics switches on a heater in the atomizer which heats a liquid to create vapour which is inhaled by the user.

Some electronic cigarettes use a so-called cartomizer which is a combination of an integrated liquid container and an electrically heatable atomizer in a single disposable unit. The cartomizer is replaced when all liquid in the liquid container has been atomised. Other types of electronic cigarettes use a so-called cartridge system, where the liquid container is separate from the atomizer. In cartridge systems, a cartridge containing liquid is attached to an atomizer, with liquid flowing from the cartridge to the atomizer. When the liquid is used up, then the cartridge is removed and replaced while the atomizer is re-used.

An advantage of the cartridge system is that a user can change the type and flavour of liquid being atomised without unnecessary disposal of an atomizer. Replacing a cartridge usually requires removal of the mouthpiece of the electronic cigarette to expose the cartridge. Then the exposed cartridge must be gripped by the user and removed. A new cartridge is then inserted and the mouthpiece is then reattached. A drawback of the cartridge system is that the user may come into contact with condensation on the surface of a used cartridge. A cartridge can get stuck on or in the electronic cigarette, making removal of the cartridge difficult, especially if the cartridge is wet due to condensation.

It is an object of the invention to provide an improved system which lessens this drawback, and which allows the cartridge to be removed and replaced in a more user-friendly manner.

DETAILED DESCRIPTION OF THE DRAWINGS

Figure 1:
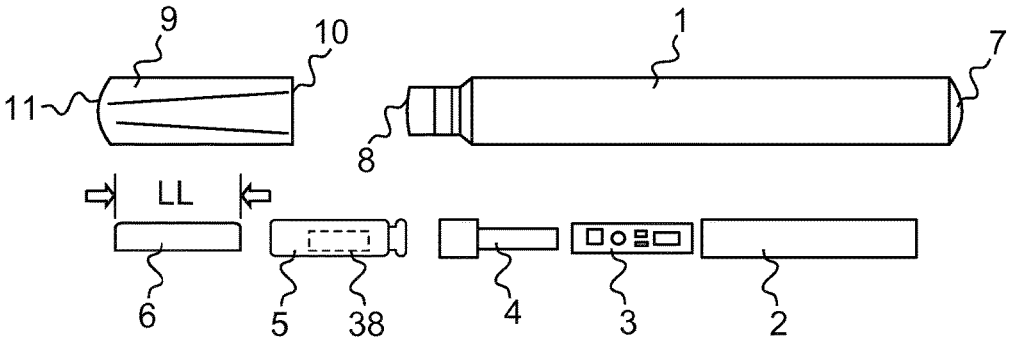
FIG. 1 is an exploded schematic view of an electronic smoking device.

FIG. 1 is an exploded view of an electronic smoking device having a housing 1 containing a battery 2 electrically connected to a printed circuit board or electronic controller

3, an atomizer 5, and a puff sensor 4. The housing 1 has a closed end 7 and an open end 8. A mouthpiece 9 closes off the open end 8 of the housing 1. A capsule 6 containing liquid is positioned within the mouthpiece.

The battery 2, which is preferably a rechargeable battery, provides electric power to a heating element 38 in the atomizer 5 and to the control electronics on the controller 3. The puff sensor 4 is configured to detect when a user sucks on the mouthpiece 9, thereby causing the controller 3 to supply electrical current to the heating element 38 in the atomizer 5.

Figure 2A:
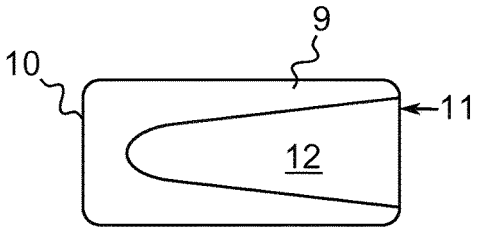
FIGS. 2A, 2B and 2C are top, side and perspective end views of a mouthpiece.
Figure 2B:
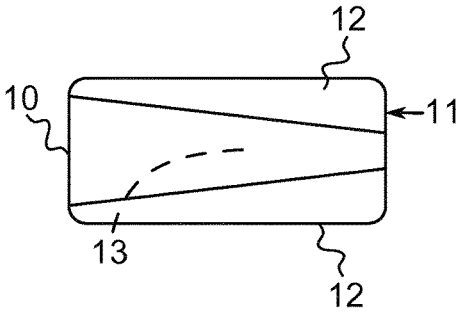
Figure 2C:
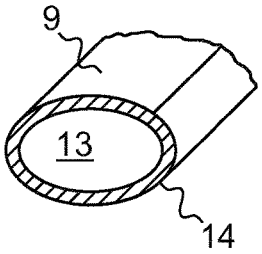

FIGS. 2A and 2B show a top and a side view of the mouthpiece 9. The mouthpiece 9 has a first end 10 which is configured for attachment to the open end 8 of the housing 1, and a second end 11. Top and bottom portions of the mouthpiece 9 may have beveled contact areas 12 to provide an enlarged contact area for the lips of the user. FIG. 2C is a perspective end view of the mouthpiece 9 viewed from the first end 10 of the mouthpiece.

Within the mouthpiece 9, a passageway 32 leads into a receiving compartment 13 configured to receive a capsule 6. The combined length of the passageway 32 and the receiving compartment 13 may be twice the length LL of the capsule 6, and preferably a length longer than LL plus at least two times a width of the capsule. The combined length of the passageway and the receiving compartment is selected so that a spent capsule may be ejected automatically through the capsule ejection port 15, or so that the spent capsule projects far enough out of the ejection port to allow it to be easily gripped manually, as described below.

When using an electronic cigarette, vapor may condense in the interior of the mouthpiece 9 and/or the exterior of the capsule 6. In the present electronic cigarette, the walls of the receiving compartment 13 may be lined with an absorber 14 to absorb any condensed vapor. The absorber 14 may be provided in the form of several segments spaced apart along a circumference of the receiving compartment. By having several segments a more effective usage of the available space within the mouthpiece can be achieved. The absorber 14, if used, may optionally be provided as single unitary absorber of tapering thickness. The absorber 14 may also be provided as a circumferential element, for ease of manufacturing, especially if the absorber is in the form of a unitary element.

The thickness of the absorber may increase toward the back end 11 of the mouthpiece to increase the amount of absorbing material in the mouthpiece and provide better absorbing results. The greater thickness of the absorber 14 may also offer a tighter press-fit of the capsule 6 in the mouthpiece 9. The absorber 14 may be made of lyocell and/or cellulose acetate. Both materials combine good absorbing characteristics with sufficient mechanical strength and resiliency to provide a press-fit for the capsule.

With the absorber forming a press-fit on the capsule, the capsule may be retained within the mouthpiece when the mouthpiece is removed from the housing 1. In this case, the mouthpiece acts to absorb any condensation, and also acts as an extraction tool for the extracting a used capsule from the housing 1. The user then does not need to touch the capsule itself in order to remove it.

The receiving compartment 13 may be configured to taper in width to provide a wedge-like configuration for gripping the capsule towards the front end 10 of the receiving compartment 13. This allows for compensation for variations of capsule size due to tolerances, with even nominally smaller capsules being securely gripped within the mouthpiece.

Figure 3:
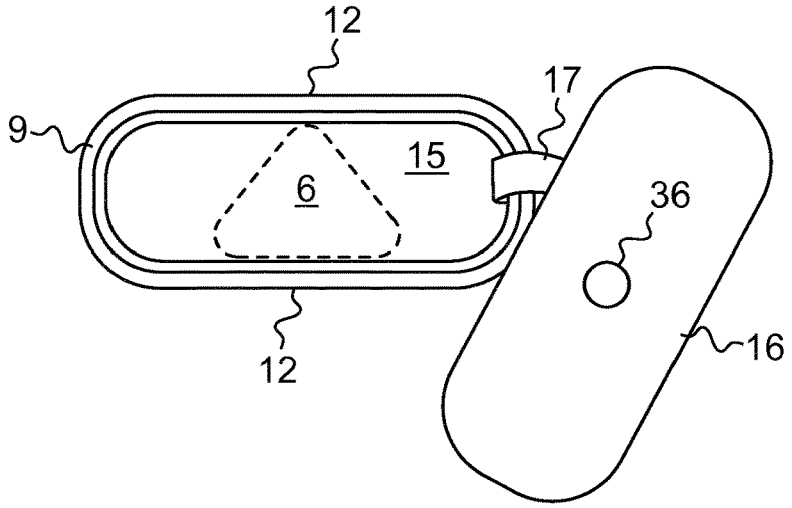
FIG. 3 is a front view of a flap attached to a front face of the mouthpiece shown in FIGS. 2A-2C.

As shown in FIG. 3, an ejection port 15 is provided at the second end 11 of the mouthpiece 13. The ejection port 15 is dimensioned and positioned so that a capsule 6 (shown in dotted lines in FIG. 3) may pass through it. The ejection port 15 is in direct communication with the receiving compartment 13 and therefore provides an exit path for the capsule 6.

In the example shown, the ejection port 15 is covered by a flap 16. The flap 16 may be attached to the second end 11 of the mouthpiece 9 by a flexible strap 17. The strap 17, the flap 16 and the mouthpiece 9 may be made of the same material, and may be integrally formed. The flap 16, when closed, covers the whole ejection port 15 and may be flush mounted at the second end 11 of the mouthpiece 9, with the flap blending into the mouthpiece 9 in both visually and in terms of tactile sensation as experienced by the user.

Preferably the capsule ejection port 15 is located solely at an end face of the mouthpiece and/or it is further preferably covered by a flap, with the capsule ejection port, and the flap (if provided) not extending to the side surfaces of the mouthpiece. This design avoids direct contact between the lips of the user and the capsule ejection port. As a result the user does not feel the presence of the ejection port and the flap during use of the electronic smoking device, which contributes to a positive user experience.

Figure 4A:
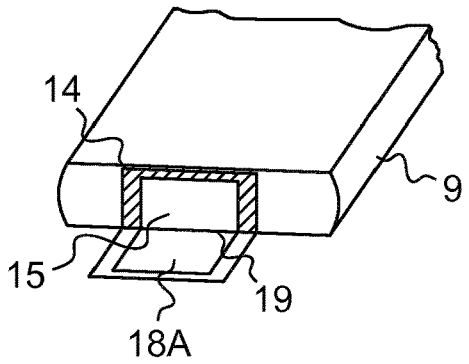
FIGS. 4A and 4B are perspective views of alternative flap designs.
Figure 4B:
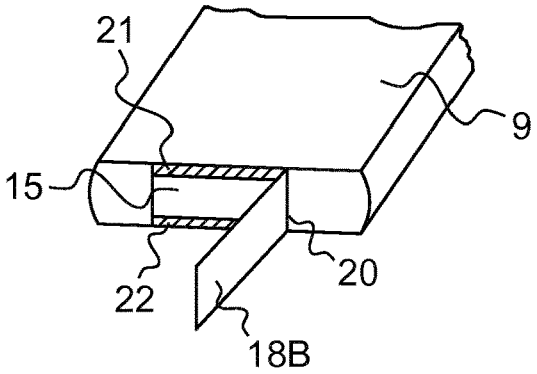

Alternative flaps 16 are shown in FIGS. 4A and 4B. In FIG. 4A a flap 18A is attached to the second end 11 of a mouthpiece 9 by a hinge 19. The flap 18A is smaller than the flap 18 shown in FIG. 3, so that the flap 18A covers only a middle portion of the second end 11 of the mouthpiece 9. The hinge 19 is attached at a lower edge of the mouthpiece 9, whereas a free end of the flap 18A rests against an upper edge of the mouthpiece 9 when closed. In FIG. 4A operation of the flap 18 allows the user to open the flap manually via the user's fingers by acting on the free end of the flap 18A at the upper edge of the mouthpiece 9. Closing of the flap 18A is performed by pushing the flap 18A back in place so that the free end of the flap 18A is returned to a position where it rests adjacent to the upper edge of the mouthpiece 9.

The flaps 18, 18A or 18B are provided to close off the back or second end of the mouthpiece. To allow air flow through the mouthpiece during use of the electronic cigarette, the flap may be removed or opened, as shown in FIGS. 4A-4C, or an inhalation opening 36 may be provided in the flap. The flap may also be provided in the form of a removable plug or a sliding door. Alternatively, the flap may be omitted entirely.

In FIG. 4B, a flap 18B is rectangular and is attached to the second end 11 of the mouthpiece by a hinge 20 along a short side of the flap. FIG. 4B also shows the absorber 14 separated into a first segment 21 at an upper portion of the mouthpiece 9 and a second segment 22 at a lower portion of the mouthpiece 9. The hinges 19 and 20 in FIGS. 4A and 4B may be resiliently self-closing.

Figure 5:
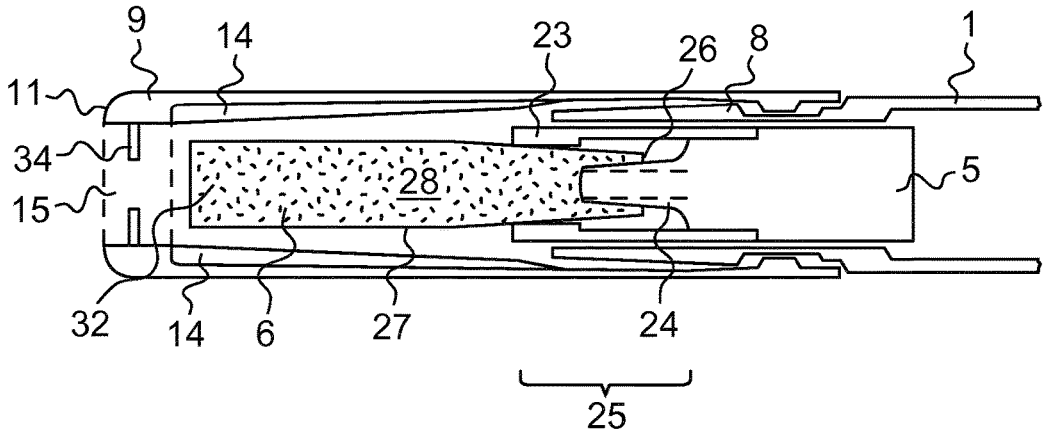
FIG. 5 is a cross-section view of a mouthpiece attached to an end of a main body of an electronic smoking device.

FIG. 5 is a cross-section of an electronic cigarette having an atomizer 5 including a cylindrical pipe 23 extending to the capsule 6, with the cylindrical pipe 23 surrounding a spike 24 at the back end of the atomizer 5. Together the pipe 23 and the spike 24 form a capsule seat 25 for a capsule 6. The liquid containing or liquid-filled capsule 6 has a shell 27 filled with liquid and sealed by a puncturable membrane 26 at the front end of the capsule. The liquid may be free flowing. Alternatively wadding or wicking material soaked with liquid may be contained within the interior of the capsule. When the capsule 6 is inserted into the pipe 23, the spike 24 punctures the membrane 26. Liquid from the interior of the capsule 6 then moves into contact with the atomizer 5.

Referring still to FIG. 5, the thickness of the absorber 14 may vary, with the absorber thickest at the second end 11 of the mouthpiece 9 becoming thinner near a first end 10 of the mouthpiece 9, where the attaches to the housing 1.

Figure 6A:
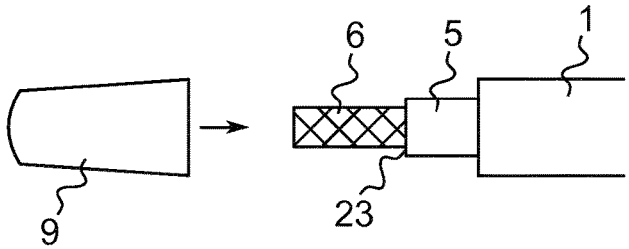
FIGS. 6A-6G are side views showing a sequence of steps performed to change a capsule.
Figure 6B:
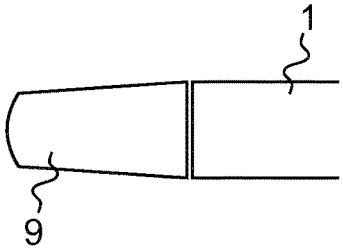

The sequence of attaching the capsule 6 and the mouthpiece 9 to the main body or housing 1 of an electronic cigarette is shown in FIGS. 6A-6G. As shown in FIG. 6A, initially a capsule 6 is mounted on the atomizer 5 in the main housing 1 by inserting it into the seat 25 provided by the pipe 23 and the spike 24 of the atomiser 5. The mouthpiece 9 is then attached to the housing 10 by pushing it in the direction of the arrow in FIG. 6A until the configuration of FIG. 6B is reached.

As shown in FIG. 6B, the capsule 6 and the pipe 23 are wholly enclosed by the mouthpiece 9 with the capsule 6 positioned within the receiving compartment 13 of the mouthpiece 9. Pushing the mouthpiece 9 on to the exterior of the pipe 23 also forces the puncturable membrane 26 of the capsule 6 against the spike 24, piercing the puncturable membrane 26. This allows liquid to flow from the interior of the capsule onto the atomiser 5 where the liquid is atomized in response to the detection of a user puffing on the mouth piece 9.

Figure 6C:
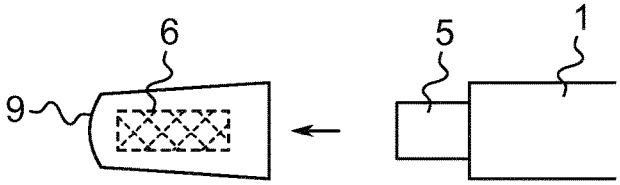
Figure 6D:
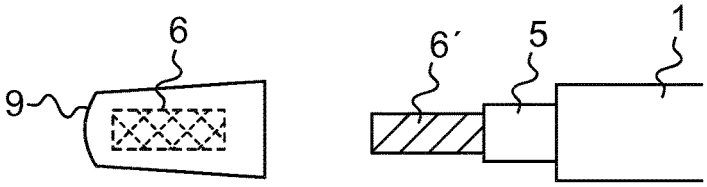
Figure 6E:
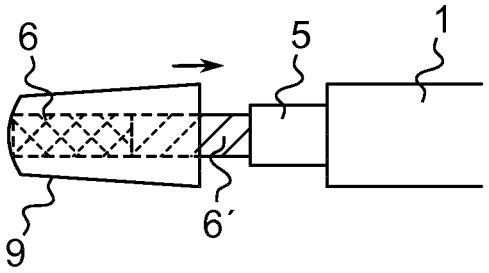
Figure 6F:
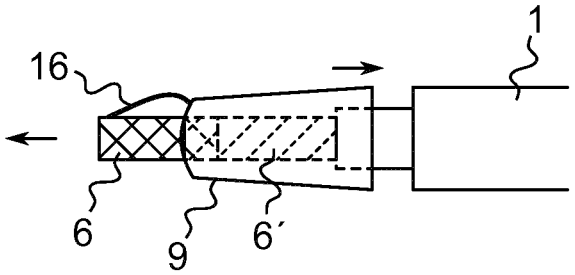

To exchange a first or spent capsule 6 with a fresh replacement or second liquid containing or liquid-filled capsule 6', the user removes the mouthpiece 9 by pulling it in the direction of arrow in FIG. 6C. In this embodiment, due to the press-fit in the absorber 14, the spent capsule 6 is held within the receiving compartment 13 in the interior of the mouthpiece 9 as the mouthpiece is separated from the pipe 23. The capsule 6 is removed from the seat 25 simultaneously with removing the mouthpiece 9 from the housing 1. In a next step as shown in FIG. 6D, the user attaches a new capsule 6' to the seat 25 of the atomizer 5. The user then reattaches the mouthpiece 9 to the housing 1 by pushing the mouthpiece 9 in the direction of the arrow in FIG. 6E. With movement of the mouthpiece 9 further towards engagement with the housing 1, the spent capsule 6 is pushed out of the mouthpiece through the receiving compartment 15 by the new capsule 6' as shown in FIG. 6E. As shown in FIG. 6F, the spent capsule 6 ultimately causes the flap 16 enclosing the ejection port 15 to open and the spent capsule 6 is ejected out via the ejection port 15. The mouthpiece may held over a waste bin or can, so that the spent capsule 6 is ejected out of the mouthpiece and falls into the waste bin. This avoids any need for the user to handle the spent capsule.

Figure 6G:
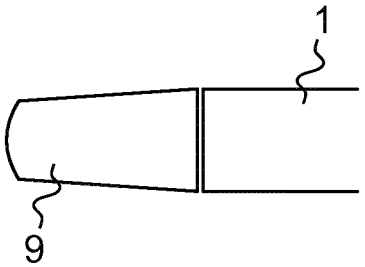

When the spent capsule 6 has been fully ejected, the mouthpiece 9 is fully attached to the main housing 1, returning to the operating configuration as shown in FIG. 6G. The new capsule 6' and the pipe 23 are enclosed by the mouthpiece 9 with the new capsule 6' positioned within the receiving compartment 13 of the mouthpiece 9.

As with the previous capsule 6, pushing the mouthpiece 9 on to the exterior of the pipe 23 also forces the puncturable membrane 26 of the capsule 6 against the spike 24 piercing the puncturable membrane 26 and enabling liquid to flow from the interior of the capsule 6 onto the atomiser 5. At the end of the process, the flap 16 is closed again thereby closing the mouthpiece 9 and the electronic smoking device is ready for operation again. Via this method, a user may change the capsule without having to touch the spent capsule 6.

Figure 7:
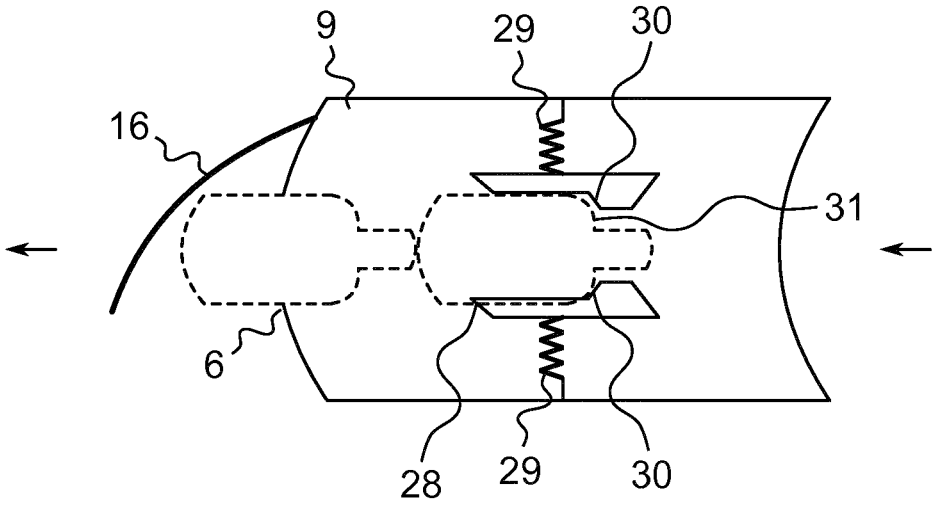
FIG. 7 is a schematic view cross-sectional view of stoppers in an alternative mouthpiece.

As described, a capsule 6 may be retained within a receiving compartment 13 where a push fit is achieved by virtue of a tapered absorber 14. In some embodiments the resilience of an absorber 14 will be sufficient to enable a capsule 6 to be retained within a receiving compartment 13. However, in other embodiments and alternative approach for securing the capsule may be used. For example, as shown in FIG. 7, stoppers 28 are provided within the receiving compartment 13 to secure the capsule 6 in place in the mouthpiece 9 even more strongly. The stoppers 28 are mounted with spring like elements 29 and exert a force towards each other, thereby clamping the capsule 6 between the stoppers 28.

The stoppers 28 may have latches 30 which are form-fit with the capsule 6. The capsule 6 correspondingly may have an annular shoulder 31 forming a complementary part to the latch 30. The capsule 6 may then be held between the stoppers 28 in a non-return manner, i.e. the capsule 6 can leave the mouthpiece 9 only in the same direction from which it was inserted. Hence, the capsule 6 may be inserted only from the right side into the mouthpiece 9 and—once the capsule 6 is spent, it may be removed only through the ejection port 15 on the left side of FIG. 7.

The stoppers 28 may optionally be provided as an elastic tongue oriented in the direction of insertion of the capsule. An elastic tongue may provide secure gripping even of capsules having different diameters due to manufacturing tolerances. Stoppers in the form of angled pins or teeth, one-way rollers or ratchets may also be used.

In some embodiments a wiping blade 34 may be provided to wipe an external surface of a capsule ejected from the receiving compartment. The wiping blade may be provided by a resilient material where the blade projects into the passageway 32. As the capsule is ejected the wiping blade 34 deforms and presses against the exterior of the capsule thereby wiping the capsule surface, to further assist in reducing a user's contact with condensate adhering to the exterior of a spent capsule.

Although in some embodiments it may be sufficient that a user manually closes the flap 16 when a spent capsule has been ejected through the capsule ejection port, the flap may optionally be self-closing. For example a resilient hinge may be used to automatically move the flap into the closed position.

The flap may also be configured for a self-actuating opening, i.e., with no user interaction required for opening of the flap. With the receiving compartment 13 and passageway 32 appropriately dimensioned, simply reattaching the mouthpiece to the housing will automatically cause the spent capsule push the flap open, so that the spent capsule to be ejected through the ejection port. Additional mechanical elements for affecting the self-actuating opening of the flap are thus not required. In some designs however, a separate push-rod may be provided in the mouthpiece, to push the flap 18 open. The interior side of the flap may be configured as a smoothed guide track for the push-rod in order to create an interface between the push-rod and the flap, for easy and reliable opening action of the flap. Thereby any unwarranted binding between the push-rod and the flap is avoided.

Thus, novel devices and methods have been shown and described. Various changes and substitutions may of course be made without departing from the spirit and scope of the invention. The invention, therefore, should not be limited, except by the following claims and their equivalents. As used here, the term electronic cigarette includes similar vapor generating devices such as electronic pipes and cigars. The term capsule as used here means a container for holding liquid for use in an electronic cigarette.

The invention claimed is:

1. An electronic smoking device, comprising:

a housing having a capsule seat adapted to hold a liquid-filled capsule, the capsule seat including a pipe and spike within the pipe;

a mouthpiece having a first end engageable onto and removable from the housing, and a second end having an ejection port, and with the mouthpiece having a receiving compartment adapted to retain the capsule.

2. The electronic smoking device of claim 1, further including an absorber within the mouthpiece.

3. The electronic smoking device of claim 2, wherein the absorber comprises a plurality of segments.

4. The electronic smoking device of claim 2, wherein the absorber tapers in thickness from the first end towards the second end of the mouthpiece.

5. The electronic smoking device of claim 2, with the absorber comprising lyocell and/or cellulose acetate.

6. The electronic smoking device of claim 1, further including a closure at the ejection port movable between open and closed positions.

7. The electronic smoking device of claim 6, wherein the closure comprises a flap resiliently attached to the mouthpiece.

8. The electronic smoking device of claim 7, wherein the flap comprises the same material as the mouthpiece.

9. The electronic smoking device of claim 6, wherein the flap is attached to the mouthpiece via a hinge and the flap is self-closing by resiliency of the hinge.

10. The electronic smoking device of claim 1, with the receiving compartment tapering in width from the first end towards the second end.

11. The electronic smoking device of claim 1, further including a retainer within the mouthpiece for securing the capsule in the mouthpiece.

12. The electronic smoking device of claim 11, with the retainer comprising an absorbent material.

13. The electronic smoking device of claim 1, further including a closure at the ejection port movable between open and closed positions.

14. A method for using an electronic smoking device, comprising:

placing a first liquid containing capsule onto a capsule seat at a first end of a housing, the capsule seat adapted to hold the first capsule, and the capsule seat including a pipe and a spike within the pipe;

attaching a first end of a mouthpiece to the first end of the housing, with the first liquid containing capsule secured within the mouthpiece, the mouthpiece having an ejection port at a second end of the mouthpiece, and the mouthpiece having a receiving compartment adapted to retain the first liquid containing capsule;

removing the mouthpiece together with the first capsule from the housing, with the first liquid containing capsule retained within the mouthpiece;

placing a second liquid containing capsule onto the capsule seat; and re-attaching the first end of the mouthpiece onto the first end of the housing and simultaneously ejecting the first liquid containing capsule from a second end of the mouthpiece.

15. The method of claim 14, further including absorbing liquid in an absorber in the mouthpiece.

16. The method of claim 14, further including opening a flap covering the ejection port at the second end of the mouthpiece.

17. The method of claim 14, further including wiping the second capsule with a wiper as it is ejected from the mouthpiece.

18. An electronic smoking device comprising:

a housing having a capsule seat adapted to hold a first liquid filled capsule, the capsule seat including a pipe and spike within the pipe;

a mouthpiece having a first end engageable onto and removable from the housing, and a second end having an ejection port, and with the mouthpiece having a receiving compartment;

the first end of the mouthpiece having an entry way leading to the receiving compartment, wherein the entry way, the receiving compartment and the ejection port are dimensioned so that the first capsule inserted into the receiving compartment via the entry way is retained within the receiving compartment and the insertion of a second capsule via the entry way causes the first capsule retained in the receiving compartment to be ejected via the ejection port.

19. The electronic smoking device of claim 18, further including an absorber within the mouthpiece.

* * * * *